United States Patent [19]

Beard et al.

[11] 4,004,372

[45] Jan. 25, 1977

[54] SLIDING DOOR CLOSER AND METHOD AND APPARATUS FOR INSTALLING THE SAME

[75] Inventors: Wallace F. Beard, Boulder City, Nev.; Jack H. Poppler; Loren C. Kienlen, both of Nisswa, Minn.

[73] Assignee: Doormaid, Inc., Nisswa, Minn.

[22] Filed: Apr. 14, 1975

[21] Appl. No.: 567,928

[52] U.S. Cl. ..... 49/404; 16/72; 16/84

[51] Int. Cl.[2] ..... E05D 15/06

[58] Field of Search ..... 16/72, 78, 75, 77, 82, 16/84, 63, 67; 49/404, 425

[56] References Cited

UNITED STATES PATENTS

| | | | |
|---|---|---|---|
| 987,289 | 3/1911 | Fairall | 16/84 |
| 3,011,223 | 12/1961 | Bender | 49/453 |
| 3,143,773 | 8/1964 | Glenn | 16/78 X |
| 3,267,513 | 8/1966 | Wartian | 16/67 |
| 3,278,979 | 10/1966 | Clement | 16/84 X |

*Primary Examiner*—Kenneth Downey
*Attorney, Agent, or Firm*—John W. Adams

[57] ABSTRACT

This is a closer for sliding doors which includes a coil spring and a cushioning element in combination therewith and is specifically constructed to facilitate attaching the same to a sliding door and the invention also includes the method and apparatus for attaching the closer.

4 Claims, 16 Drawing Figures

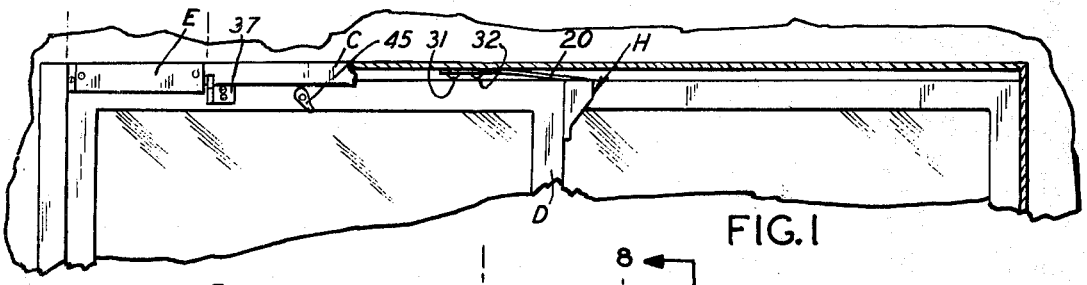
FIG. 1
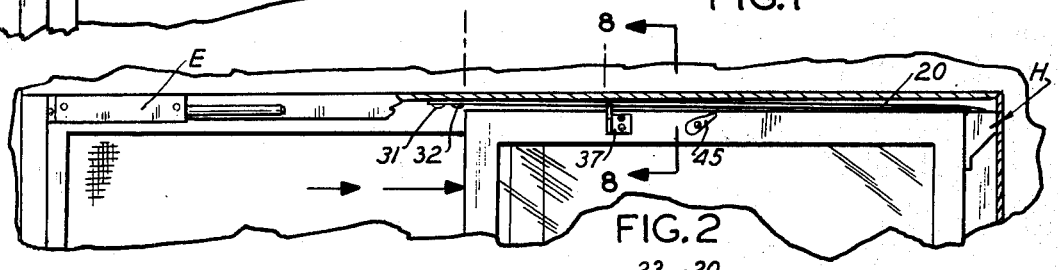
FIG. 2
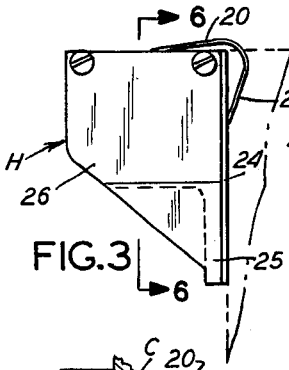
FIG. 3
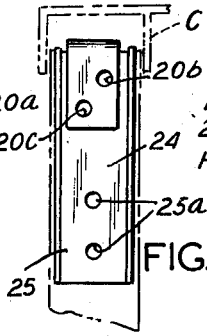
FIG. 4
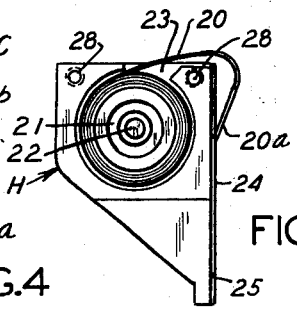
FIG. 5
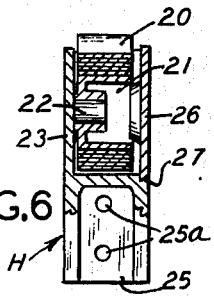
FIG. 6
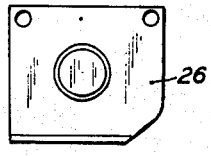
FIG. 7
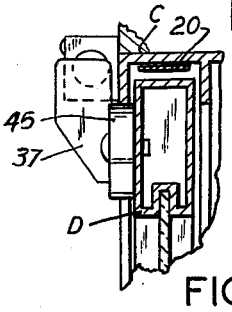
FIG. 10
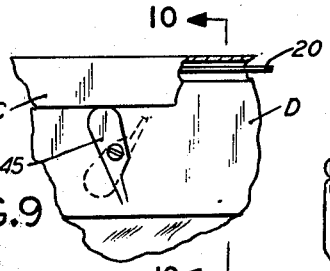
FIG. 9
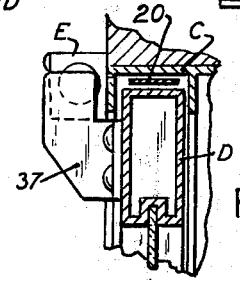
FIG. 8
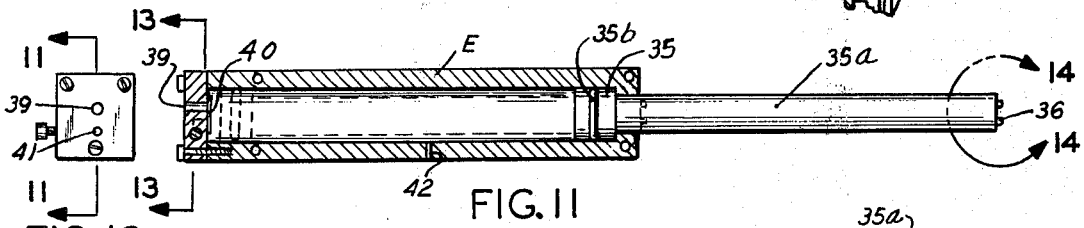
FIG. 11
FIG. 12
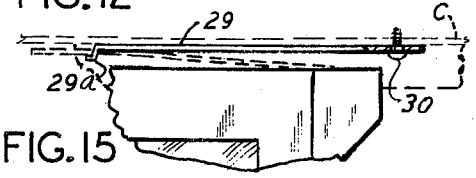
FIG. 15
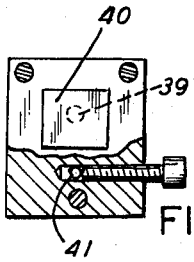
FIG. 13
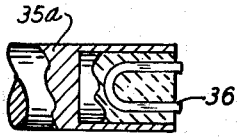
FIG. 14
FIG. 16
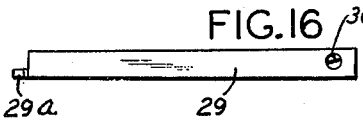

SLIDING DOOR CLOSER AND METHOD AND APPARATUS FOR INSTALLING THE SAME

It is an object of this invention to provide a coil spring type closer for sliding doors which cushions and retards the final stages of the closing movement of the door.

It is another object to provide a closer for sliding doors which is specifically designed to facilitate installation thereof.

It is still a further object to provide a method of installing a closer for sliding doors.

These and other objects and advantages of this invention will more fully appear in the following description made in connection with the accompanying drawings in which like reference characters refer to similar parts throughout the several views, and, in which:

FIG. 1 is fragmentary front elevational view, partially in vertical section, showing a sliding door with my door closer installed thereon and showing the door in closed position;

FIG. 2 is a similar view showing the door in open position;

FIG. 3 is an elevational view showing the spring closer unit before installation and showing the upper portion of a door by dotted lines;

FIG. 4 is an end elevational view of the closer unit shown in FIG. 3 and illustrating the door and guide channel by dotted lines;

FIG. 5 is a view similar to FIG. 3 with the cover plate removed;

FIG. 6 is a vertical sectional view taken substantially along the line 6—6 of FIG. 3;

FIG. 7 is an elevational view of the cover plate per se showing the inside thereof;

FIG. 8 is a fragmentary vertical sectional view showing the sliding door mounted in its upper guide channel and illustrating the attachment of the cushioning element;

FIG. 9 is a fragmentary front elevational view of the sliding door showing a locking cam for holding the same in open position;

FIG. 10 is a transverse vertical sectional view showing locking cam engaged with the guiding channel to hold the door in open position;

FIG. 11 is a longitudinal vertical sectional view of the cushioning device;

FIG. 12 is a rear end elevational view thereof;

FIG. 13 is a transverse vertical sectional view taken substantially along the line 13—13 of FIG. 11;

FIG. 14 is a fragmentary vertical sectional view of the extensible forward portion of the cushioning plunger showing a magnet mounted therein;

FIG. 15 is a fragmentary vertical sectional view showing the installation tool in operative position during attachment of the closer spring; and FIG. 16 is a top plan view of the apparatus shown in FIG. 15.

A housing H is provided and has an integrally molded plastic body with a spring receiving cavity formed therein. A constant force coil spring 20 such as is disclosed in U.S. Pat. Nos. 2,609,191 or 2,609,192 is mounted around a central hub member 21 which in turn is journaled on a pivot shaft 22 which is integrally formed with one side 23 of the housing H. The free end of the coil spring 20 is bent to form a retaining hook portion 20a which engages the outside of the end wall 24 of the housing H as best shown in FIG. 5, until installation. This hook portion **20*a* has a pair of apertures 20*b* and 20*c* therein. The housing H has a depending attachment portion 25 for attaching the same to the upper overlapping edge portion of a sliding door D which is mounted in a fixed channel frame structure C. Screw holes 25*a* are provided in the attachment portion 25, as best shown in FIG. 6, for attaching the same to the upper portion of the overlapping edge of the door. A cover plate 26 is attached to the side of the housing H by inserting the beveled lower edge under a cooperatively undercut beveled portion 27 of the housing and is held in place by a pair of screws received in the holes 28** formed in the upper portion of the housing.

To install the spring motor unit the housing H is initially attached to the upper edge portion of the door, preferably left somewhat loose to facilitate future alignment, and the hood end **20*a* of the spring 20 straightened out and is extended back over the upper edge of the sliding door by means of a special tool 29, best shown in FIGS. 15 and 16, which is positioned with hook 29*a* hooked into the first (right hand) attachment hole 20*b* in the end portion of spring 20. The top of the door D is spaced below the horizontal portion of the channel E and is inserted into this space above the door D between the depending flanges of said channel and overlying the extended portion of the spring. The free end of the tool extends beyond the right overlapping edge of the door and is attached to the door frame within said channel as by a screw 30, also best shown in FIGS. 15 and 16. The sliding door D is then shifted into open position as best shown in FIG. 2 with the installing tool 29 anchoring the free end of the spring in the desired position with the spring extended over the upper edge of the door D within fixed channel frame member C. This exposes the attachment end 20*a* of spring 20 and the second hole 20*c* therein. A screw is then inserted through said second hole 20*c* in the spring to anchor the spring to the frame C and the door is shifted back into closed position. The right hand end portion of the tool 29 is then exposed and may be left in position if desired or may be removed by removing the screw 30 and then twisting the hook 29*a* out of the hole 20*b* in the end of the spring. This then permits a second screw 32 to be inserted through the first hole 20*b* to securely anchor the spring to the door frame channel as best shown in FIG. 1** by sliding the door back into open position.

A cushioning damper E is mounted on the inside of channel frame C as by a plurality of short sheetmetal screws. The cushioning damper E has a plunger 35 with a rod **35*a* fixed thereto and is provided with suitable sealing means such as the O-ring 35*b*. A magnet is fixed to the free end rod 35*a* and a ferrous metal bracket 37 is fixed to the door as shown in FIGS. 1, 2 and 8. The magnet 36 in the end of rod 35*a* attaches to bracket 37** and this magnetic attachment is sufficiently strong to pull the rod out into extended position when the door is initially opened.

When the rod **35*a* has been fully extended the plunger 35 will engage the retaining flange at the end of the cylinder and the bracket 37 will separate from the magnet 36 as best shown in FIG. 2**.

When the spring closes the door, the rod 35a will be retracted back into its housing cylinder. The damper action of the cushioning unit E is otherwise of conventional design, having a flap valve 40 controlling the vent 39 for closing the vent during retraction of the rod but permitting air to move freely into the cushioning chamber as the plunger is moved out into extended position. The damper action is provided by a needle valve controlled discharge vent 41 in the chamber which may have an additional vent 42 to permit faster closing for a portion of the cushioning stroke.

A suitable locking cam 45 may be provided on the door to hold the same in open position against the force of the spring 20.

It will, of course, be understood that various changes may be made in the form, details, arrangement and proportions of the parts without departing from the scope of this invention as set forth in the appended claims.

What is claimed is:

1. A cushioned door closer for a sliding door having top and bottom edges and a pair of vertical edges, one an overlapping edge and the other an abutting edge and mounted in an upper channel having a horizontal top portion spaced above the top of the door and provided with depending guide flanges which capture the upper edge portion of the door, said door closer comprising, a closer housing with a pivot shaft therewithin attached to the upper portion of the overlapping edge of the sliding door, a coil return spring having the coil thereof journalled on said shaft and enclosed within said housing and having a free end attachable to the horizontal top portion of the channel member in substantially concealed relation above the upper edge of the door between the depending guide flange of the channel, means for cushioning the door during the final stages of movement under the force exerted by said return spring and including an extensible rod member with means for limiting the speed of retraction thereof, a rod extending member mounted on said door for moving said rod into extended position whenever the door is moved into open position, a magnet attached to one of said members and a ferrous metal magnet-engaging portion mounted on the other member in alignment with said magnet for engagement therewith to pull the extensive member into fully extended position, and stop means for limiting the extending movement of the extensible member and the two members separating when the extensible member has been pulled into fully extended position against said stop means and thereafter the door is moved further into open position.

2. The method of installing a sliding door closer comprising connecting the spring and closer housing to an exposed edge of a sliding door, attaching a stiff tool member to the free end of the spring, attaching the other end of said tool member to the portion of the frame above said door at a point exposed beyond the said edge of the door, sliding said door into fully open position to expose the free end of said spring element, and attaching said free end of the spring to the upper portion of the frame.

3. The method set forth in claim 2 and moving said door back into closed position to expose the end of said tool, and removing the tool from the frame and from the free end of the spring.

4. A sliding door closer in combination with a tool for installing the same comprising, a housing attached to an exposed vertical edge portion of a sliding door, a coil spring door closer element having the coiled portion thereof mounted within the housing and having a free attachment end portion with attaching apertures therein, a stiff installing tool attached at one end of the frame above the door, the other end of said tool having a hook thereon attached in overlying relation to the free end of the spring element through one of said apertures, said tool being of sufficient length to expose an end portion thereof beyond the exposed edge of said door to permit easy attachment of the tool to the upper frame portion, whereby said tool anchors the free end of said spring element when the door is moved into open position to expose the free end beyond the other vertical edge of said door to provide access for attaching the free end of the spring to the door frame.

* * * * *